United States Patent [19]

Firth et al.

[11] 4,332,463

[45] Jun. 1, 1982

[54] NON-SYNCHRONOUS OPERATION OF AN ELECTRONIC COPIER

[75] Inventors: Ronald R. Firth, Fairport; Lee N. Davy, Rochester, both of N.Y.

[73] Assignee: Eastman Kodak Company, Rochester, N.Y.

[21] Appl. No.: 161,543

[22] Filed: Jun. 20, 1980

[51] Int. Cl.[3] ..... G03G 15/00

[52] U.S. Cl. ..... 355/14 R; 346/153.1; 355/3 R; 360/15

[58] Field of Search ..... 355/3 R, 16, 14 R; 358/300; 346/153.1, 160; 360/15, 69, 79

[56] References Cited

U.S. PATENT DOCUMENTS

| | | | |
|---|---|---|---|
| 3,749,833 | 7/1973 | Rait et al. | 346/160 X |
| 3,867,569 | 2/1975 | Watson | 358/293 |
| 3,914,047 | 10/1975 | Hunt et al. | 355/16 |
| 4,019,733 | 4/1977 | Montalto | 271/245 |
| 4,105,324 | 8/1978 | Seil | 355/14 |
| 4,204,725 | 5/1980 | Distefano et al. | 355/3 R |
| 4,251,153 | 2/1981 | Levine | 355/3 R |
| 4,268,159 | 5/1981 | Tashiro | 355/3 R |

*Primary Examiner*—Richard L. Moses
*Attorney, Agent, or Firm*—Robert F. Cody

[57] ABSTRACT

In an electronic copier of a type that includes a document scanner, a memory device and a printer, a complex servo system is generally used to provide phase synchronous operation between such copier components. In accordance with the present invention, methods and apparatus are provided wherein an electronic copier is operated in a "free running" mode without such phase synchronization. Specifically, in accordance with a disclosed embodiment of the invention, a composite information signal corresponding to an original document is stored in the memory device in the form of document information sandwiched by leading and trailing pilot signals. Upon playback, certain copier functions are so coordinated with the termination of the leading pilot signal that problems which would be expected in the absence of a servo system, such as image registration errors, are avoided.

18 Claims, 23 Drawing Figures

RECORDING LOGIC SEQUENCE

RECORDING LOGIC SEQUENCE

RECORDING SEQUENCE OF EVENTS

L.P.S. MAX DURATION = 38 SECTORS
DOCUMENT INFO = 72 SECTORS

PLAYBACK LOGIC SEQUENCE

PLAYBACK LOGIC SEQUENCE (CONT.)

PLAYBACK SEQUENCE OF EVENTS

DOCUMENT ONE
DOCUMENT TWO
DOCUMENT THREE
START

ENABLE

STEPPING PULSES

OR

DEACTIVATE

R/W ENABLE

NON-SYNCHRONOUS OPERATION OF AN ELECTRONIC COPIER

FIELD OF THE INVENTION

The present invention relates to an electronic copier and, more particularly, to an electronic copier that is operated without phase synchronization between copier components that normally are so synchronized.

DESCRIPTION RELATIVE TO THE PRIOR ART

Whenever the term "document" is used throughout the specification and accompanying claims, it refers to a medium such as a sheet or web having an image to be copied. The term "copy" refers to the output of a copier such as a copy sheet or web having a visible representation of document information thereon.

An electronic copier generally includes three major sub-systems: a document scanner, a memory device and a printer. The function of the document scanner is to convert image information on a document into an electronic document information signal. Such conversion may be performed, for example, by scanning an optical image of an original document across a line sensor in the form of a charge coupled device (CCD) linear image array. Repeated readout of the line sensor during the optical scanning process produces a line sequential document information signal wherein the total number of lines per document page is determined by the optical scan rate and the clocking rate of the line sensor. The document information signal is then stored in a memory device such as a rotating disk or drum. To produce a replicate of the original document, the stored document information signal is reproduced from the memory device and fed to a printer. The function of the printer is to produce a visible representation of the document information signal on, for example, a copy sheet or web.

If the document scanner, memory device and printer are not all operated in phase synchronization, replicated document information will not, in general, be properly registered on the copy. Such registration error has two causes: First, without phase synchronization between the document scanner and the memory device, there is uncertainty as to the physical location of document information within the memory device. For example, in the case of a memory device in the form of a constantly rotating disk, recording of information corresponding to respective document pages will, in general, begin at different angular locations on the disk. This is because the disk will be in a different angular orientation as recording of the information for each document is commenced. The second cause of registration error arises from the lack of phase synchronization between the memory device and the printer. Without such synchronization, the printer will, in general, initiate its functions too early or too late relative to readout of document information from the memory device, thereby resulting in registration error.

Providing phase synchronization between the document scanner, memory device and printer in such a manner as to eliminate registration error is not a simple matter. One reason is that phase synchronization is inherently time consuming because of its "iterative" nature. To achieve phase synchronization, it is first necessary to obtain speed synchronization between the copier components, and then detect and correct for phase error by changing the relative speeds of the copier components. Speed synchronization is then reestablished and the relative phases of the copier components again checked for error. This process is repeated until the detected phase error was within tolerable limits.

The time consuming nature of phase synchronization is particularly disadvantageous in the case of an electronic copier because of the stop-start nature of copier operation (which thus requires repeated phase synchronization of the copier components) and because of the relatively large masses which must be phase synchronized. A servo system that would perform satisfactorily under these conditions would be expensive and complex. For example, phase error detectors would be required for the various copier components. Further, in order to obtain acceptable cycling rates for the copier, the servo system would require a fast response time, thereby requiring a (expensive) motor having a high torque/inertia ratio.

SUMMARY OF THE INVENTION

In accordance with the present invention, an electronic copier is disclosed that is operated in a "free running" mode without phase synchronization among its components. Even though there is a lack of phase synchronization between copier components, the disclosed copier does not exhibit the image registration errors that would be expected in the absence of such phase synchronization. In accordance with a disclosed embodiment, image information on documents is converted into respective document information signals, each of which is recorded on a memory device in the form of a pilot signal followed by the document information signal. Upon playback of the recorded information corresponding to a particular document, certain copier functions are so keyed to the termination of the played back pilot signal that problematic image registration errors are eliminated. In accordance with a further aspect, information corresponding to each document is recorded in the form of a document information signal sandwiched by leading and trailing pilot signals. This form of recorded information is particularly advantageous if the memory device is of the erasable type, as will be discussed in detail below.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENTS

The basic components of an electronic copier are the document scanner, the memory device and the printer. As discussed above, some type of mechanical servo system is generally used to phase synchronize the copier components and thereby eliminate or reduce image registration errors of document information on the document copy. In the discussion which follows, an electronic copier is disclosed that does not include mechanical apparatus for providing phase synchronization yet, for reasons discussed below, does not produce the image registration errors which would be expected in the absence of such phase synchronization apparatus.

OVERVIEW

Before discussing an embodiment of the present invention in detail, it is helpful to provide a brief overview of its major concepts. The disclosed electronic copier includes an "inertial" document scanner. By "inertial" it is meant that the scanner contains certain components (optical lenses, mirrors, etc.) that must be brought up to a predetermined speed before scanning of a document can begin. Because each component has mass, there is a finite "start-up" time between the initiation of the document scanner and the beginning of actual scanning. For part of this "start-up" time interval, a pilot signal is recorded on a memory device having the form of a constantly rotating disk storage device. Once actual document scanning begins, the pilot signal is terminated and document information is recorded on the rotating disk storage device. Upon termination of document information recording, a second pilot signal is recorded until the rotating disk reaches the same angular position at which recording of the first pilot signal began. The recorded signal corresponding to each original document, referred to as the composite information signal, thus begins and ends at the same angular position on the disk storage device and is in the form of a document information signal sandwiched by leading and trailing pilot signals.

While the first recorded (leading) pilot signal for each document begins at the same angular location on the disk, there is positional uncertainty in the location of document information on the disk because there is no phase synchronization between the document scanner and the disk storage device. To produce a copy of the original document, the recorded composite information signal is played back. Certain printer functions, discussed in detail below, are keyed to a signal transition within the composite information signal in a manner that results in a copy free from registration error. Further, because the composite information signal is the same duration for all documents, recording at the same location of information corresponding to a subsequent document results in complete erasure of the previously recorded document information.

Document Scanner and Memory Device Operation During Recording

Figure 1:
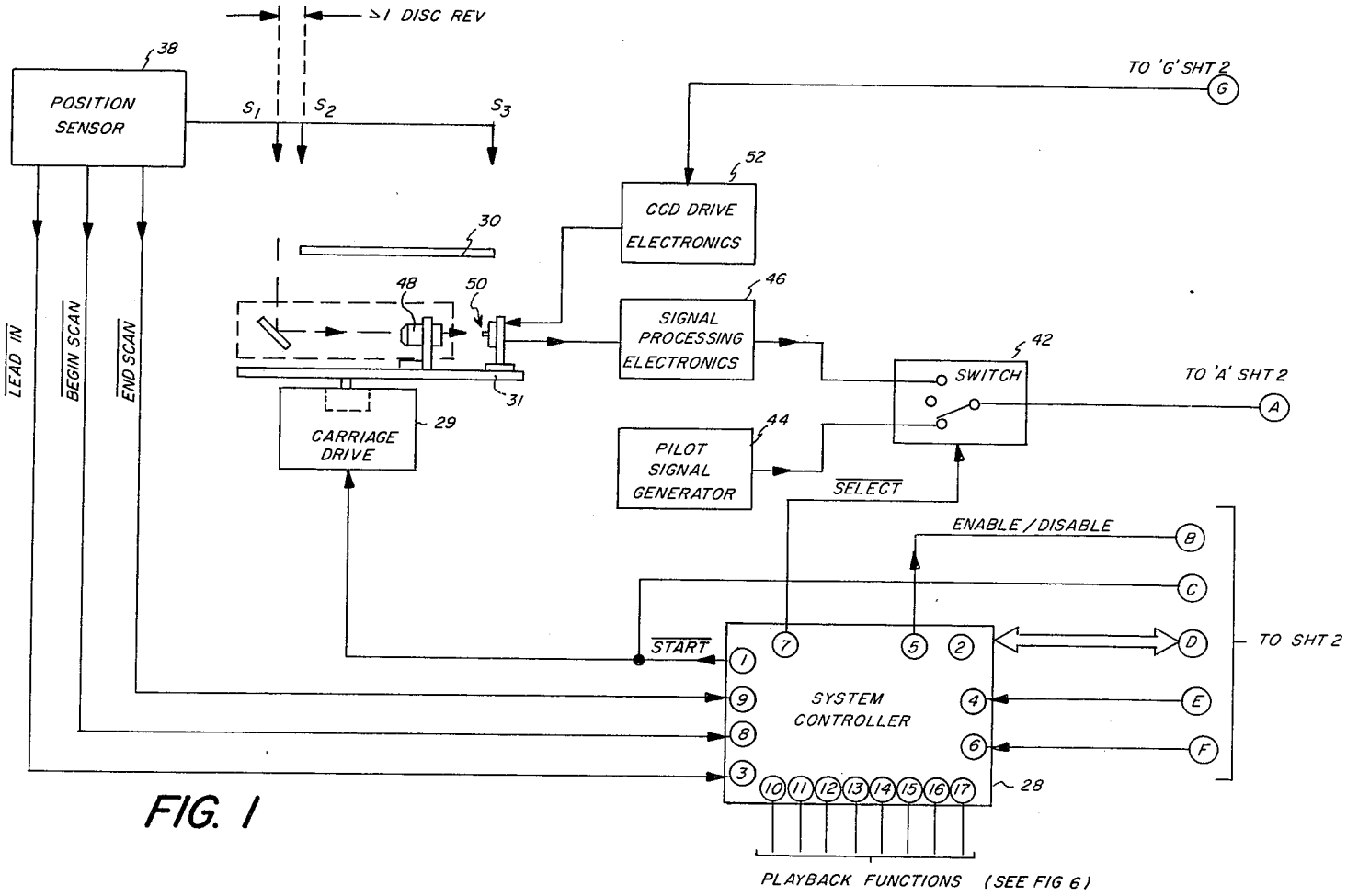
FIG. 1 and FIG. 1 (cont.) are a functional block schematic diagram showing document scanning and memory device sub-systems of an electronic copier in accordance with the present invention.
Figure 1:
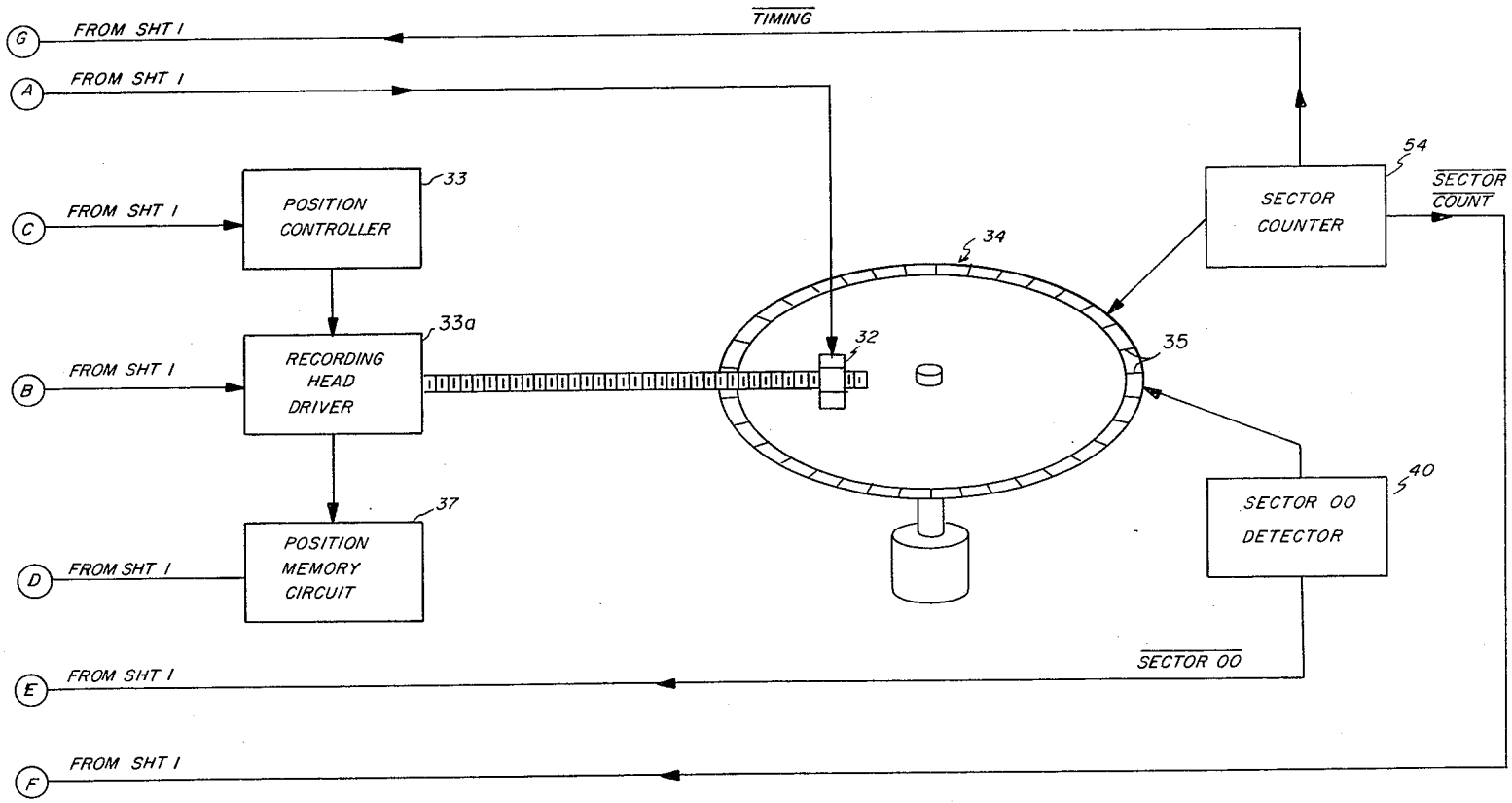
Figure 2:
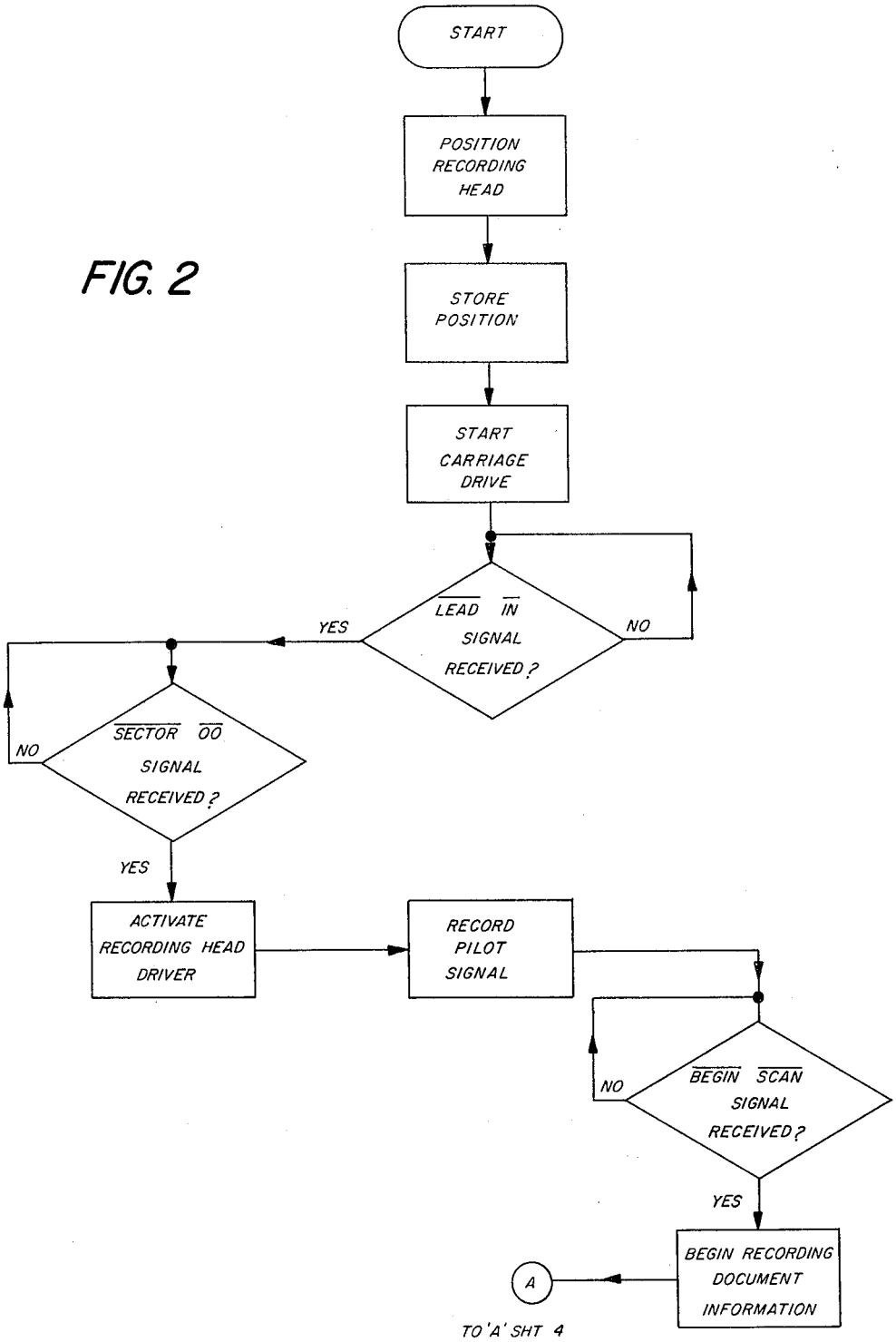
FIG. 2 and FIG. 2 (cont.) are a flow chart showing the logic sequence followed by a system controller during the recording mode of copier operation.
Figure 2:
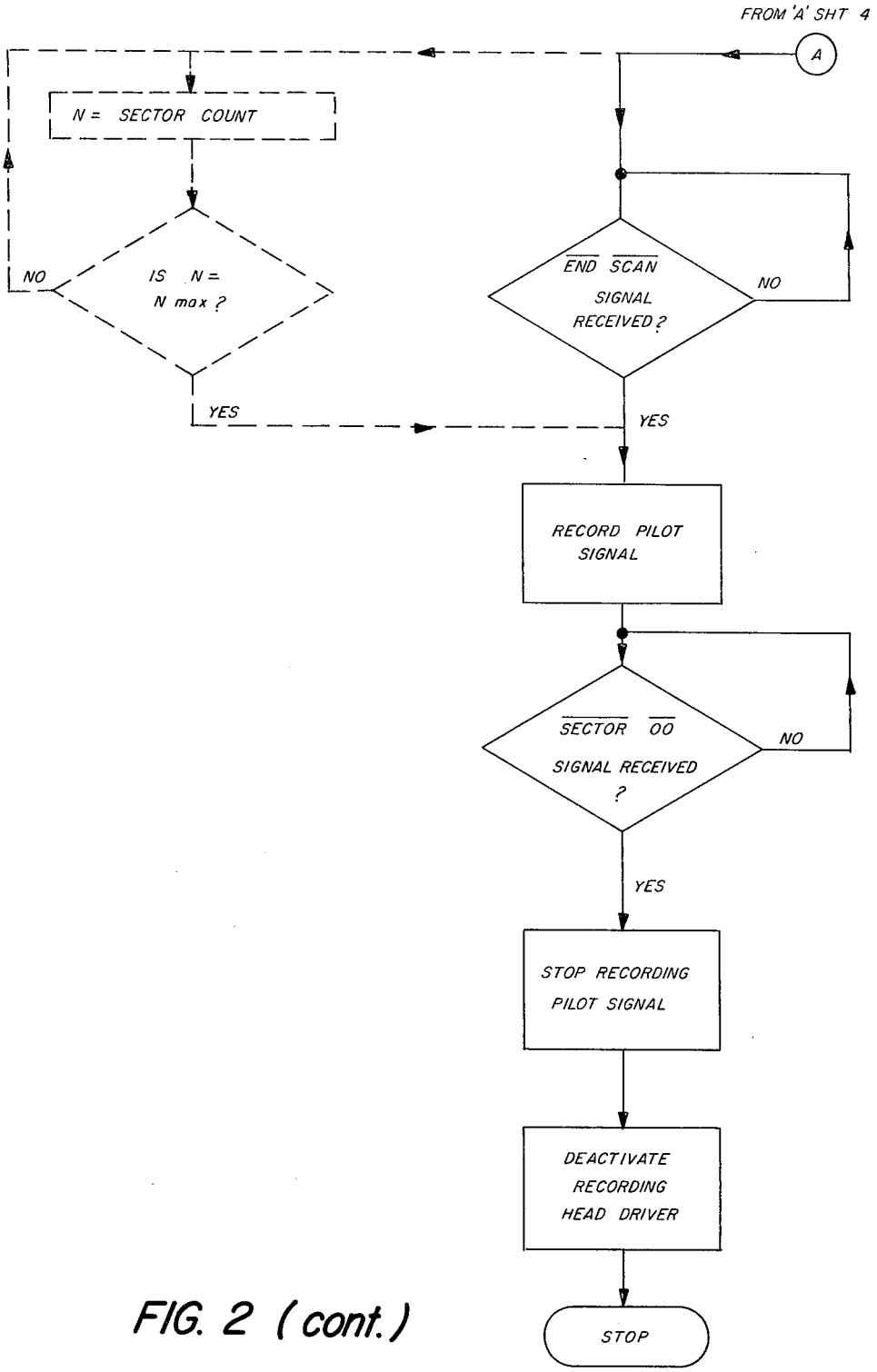

FIG. 1 is a generalized block diagram of those portions of an electronic copier in accordance with the invention that pertain to the recording of document information on a memory device. A system controller 28 coordinates the functions of individual copier subsystems. The logic flow of the system controller 28 is shown in FIG. 2 for the recording sequence. With reference to FIGS. 1 and 2, the system controller 28 commences copier operation by generating a START signal. In response to the START signal, a position controller 33 causes a recording head driver 33*a* to radially position a recording head 32 on a memory device in the form of a constantly rotating disk storage device 34. This initial position of the recording head 32 is "memorized" in a position memory circuit 37. The outer periphery of the disk storage device 34 is divided into 36 sectors by a plurality of detectable (magnetically, optically, etc.) sector markers 36. (As discussed in more detail below, the sectors are referred to as sector 00 through sector 35, and the sector mark separating sector 00 and sector 35 is made self distinguishing.) Also in response to the START signal, a carriage drive mechanism 29 starts an optical scanning carriage 31 in motion.

When the scanning carriage 31 reaches a position $S_1$ (the position shown in FIG. 1), a position sensor 38 generates a LEAD IN signal which tells the system controller 28 that document scanning is about to begin. At some point within one revolution of the disk storage device 34, the self-distinguishing sector mark (between sector 00 and sector 35) will be detected by a sector 00 detector 40, which will then generate a SECTOR 00 signal. (The sector 00 detector 40 will continue to generate a SECTOR 00 signal once each disk storage device 34 revolution thereafter.) Upon receipt of the first SECTOR 00 signal following receipt of the LEAD IN signal, the system controller 28 generates an ENABLE signal and a SELECT signal. The ENABLE signal activates the recording head driver 33*a*, thereby causing the recording head 32 to move radially across the rotating disk storage device 34. The SELECT signal causes a switch 42 to apply the output of a pilot signal generator 44 to the recording head 32. As a result, a pilot signal is recorded along a spiral track on the disk storage device 34. For illustrative purposes, it will hereinafter be assumed that recording of the pilot signal begins at the beginning of sector 00. (This condition can always be satisfied by suitably locating the sector 00 detector 40 relative to the recording head 32.)

The pilot signal continues to be recorded on the disk storage device 34 until the scanning carriage 31 reaches a position $S_2$, at which point document scanning is ready to begin. (The position $S_2$ generally coincides with the leading edge of the document to be scanned.) The positions $S_1$ and $S_2$ are so chosen that the disk storage device 34 will complete at least one revolution in the time it takes for the scanning carriage to travel from position $S_1$ to position $S_2$. This requirement ensures that a SECTOR 00 signal will always be received by the system controller 28, and thus a segment of pilot signal recorded, before the scanning carriage 31 reaches position $S_2$. When the scanning carriage 31 reaches position $S_2$, the position sensor 38 generages a BEGIN SCAN signal which tells the system controller 28 that provision should be made for terminating recording of the pilot signal and beginning recording of document information. The system controller 28 sends a second SELECT signal to the switch 42 causing the switch 42 to open the circuit between the pilot signal generator 44 and the recording head 32, and to close the circuit between a signal processing circuit 46 and the recording head 32.

As the scanning carriage 31 moves past a document 30, a light source (not shown) illuminates a slit-shaped portion of the document 30, which portion is imaged by an optical system 48 onto a line sensor in the form of a CCD (charge coupled device) linear image array 50. As is well known, when light from a scene is focused onto the surface of such a CCD, information representing the scene is stored in the CCD as charge packets, the quantity of charge in each packet being proportional to the intensity of light falling on that element per unit time. A spatial charge representation of one scan line of the document 30 is thus stored in the CCD 50. The information is transferred from the CCD 50 by clock voltages supplied by CCD drive electronics 52. The rate at which the CCD 50 is clocked is controlled by a TIMING signal from a sector counter 54 that causes one scan line of document information to be stored per sector on the disk storage device 34. The clock voltages cause the charge packets to move serially from storage site to site until all charges are outputted to the signal processing electronics 46. The signal processing electronics 46 amplifies the low-level output signal from the CCD 50 to a level more suitable for recording. The processed output signal is then recorded along a spiral track on the disk storage device 34. If a standard $8\frac{1}{2}\times 11$ inch document is scanned and there are, for example, 1500 scan lines, then 41 complete revolutions plus 24 sectors of the disk storage device 34 are required to record this information (assuming 36 sectors per disk revolution).

Document information continues to be recorded on the disk storage device 34 until the scanning carriage 31 reaches position $S_3$. The position sensor 38 then generates an END SCAN signal telling the system controller 28 that document scanning has been completed. (Alternatively, the sector counter 54 can be used to determine when document scanning is complete by counting the number of lines that have been scanned, as indicated by broken lines in the flow chart shown in FIG. 2.) In response to the END SCAN signal, the system controller 28 generates a third SELECT signal that causes the switch 42 to open the circuit between the signal processing electronics 46 and the recording head 32, and to close the circuit between the pilot signal generator 44 and the recording head 32. Recording of document information is thus terminated and recording of pilot signal resumed. The trailing pilot signal continues to be recorded on the disk storage device 34 until the system controller 28 receives a SECTOR 00 signal from sector 00 detector 40 indicating that recording of the trailing pilot signal should cease. (Depending on the number of sectors occupied by the document information signal, it may be desirable to terminate recording of the trailing pilot signal based on a SECTOR COUNT signal produced by the sector counter 54. This situation is discussed in connection with FIGS. 5*a* through 5*d*. ) The system controller 28 then generates a DISABLE signal and a fourth SELECT signal. The fourth SELECT signal causes the switch 42 to open all circuits to the recording head 32, thereby terminating recording. The DISABLE signal disables the recording head driver 35, thereby stopping radial movement of the recording head 32. At this point, document information corresponding to the original document 30 is recorded on the disk storage device 34 as a composite information signal comprised of document information sandwiched by leading and trailing pilot signals.

Figure 3:
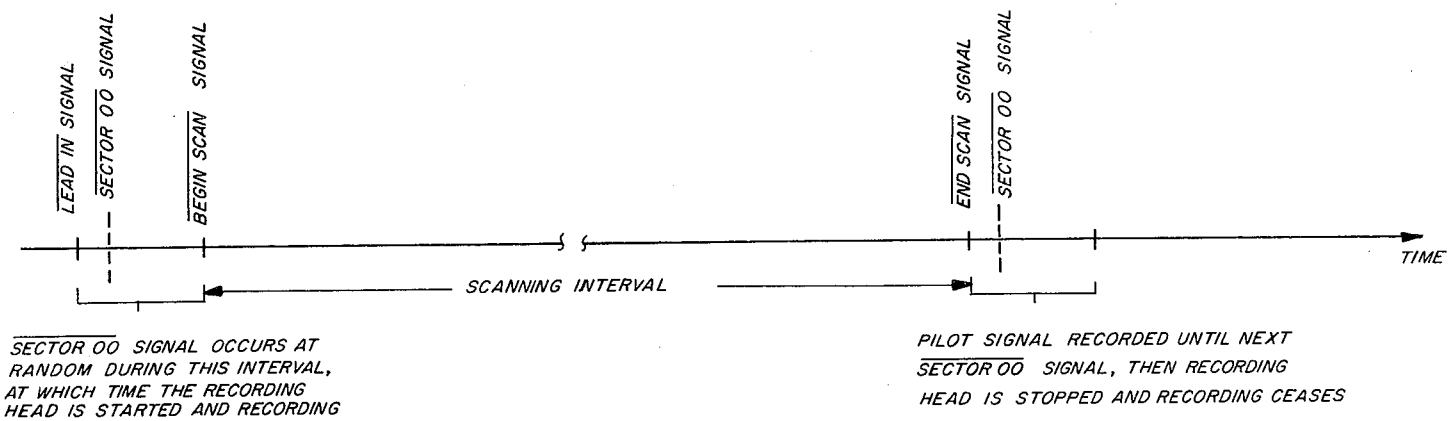
FIG. 3 is a timing diagram showing the order of certain events occurring during the recording mode of copier operation.

FIG. 3 summarizes the temporal occurrence of certain of the above-described copier functions. Insofar as the scanning operation is concerned, a LEAD IN signal indicates that document scanning is about to begin. BEGIN SCAN and END SCAN signal mark the beginning and end of document scanning, respectively. At some point in time between the LEAD IN and BEGIN SCAN signals, a SECTOR 00 signal will be produced by the sector 00 detector 40. In response to this SECTOR 00 signal, the system controller 28 enables the recording head driver 33*a* and causes the pilot signal to be applied to the recording head, thereby commencing recording of the pilot signal on the disk storage device 34. The occurrence of the BEGIN SCAN signal marks the termination of recording of the first (leading) pilot signal, and the beginning of document information recording. From the END SCAN signal to the occurrence of the next SECTOR 00 signal the pilot signal is again recorded.

Figure 4:
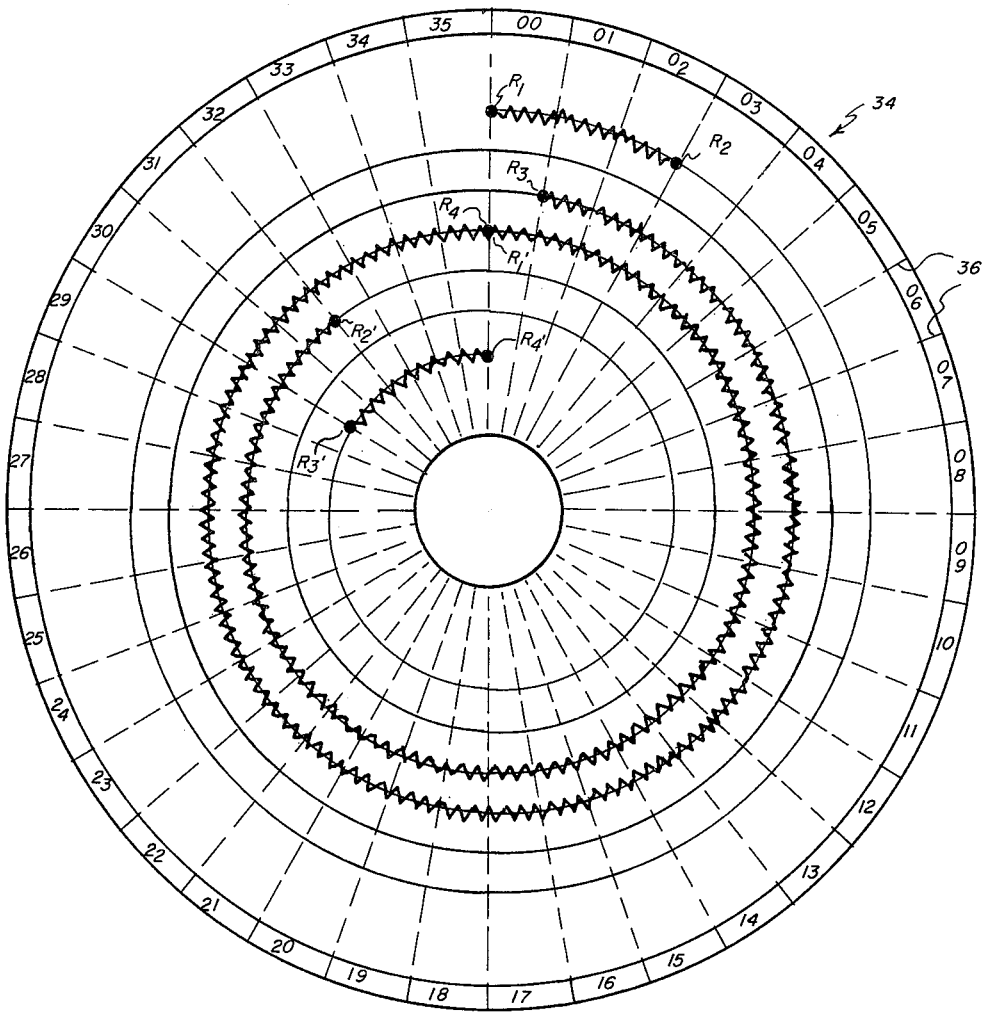
FIGS. 4 and 5*a*, 5*b*, 5*c*, 5*d* are diagrams illustrating certain concepts pertaining to the format in which document information is recorded on a memory device.

The disk storage device 34 is shown in more detail in FIG. 4. For convenience of illustration it is assumed that 70 scan lines of document information are recorded for each of two documents (rather than the 1500 scan lines in the above-discussed example). Referring to certain components already discussed in connection with FIG. 1, the recording head driver 33*a* initially positions the recording head 32 at some radial position. When the scanning carriage 31 reaches position $S_1$, the recording head 32 begins to move and recording of the leading pilot signal (indicated by a jagged line) begins at the next sector 00 ($R_1$). When the carriage 31 reaches position $S_2$, recording of document information (indicated by a smooth line) begins at, for example, sector 03 ($R_2$). Since it is assumed that there are 70 scan lines, document information is recorded for two complete revolutions less two sectors, thereby ending at the beginning of sector 01 ($R_3$). From sector 01 up to the beginning of the next sector 00 ($R_4$), the trailing pilot signal is recorded. Information for a second document is recorded in a similar manner, the corresponding positions denoted by $R_1$, $R_2$, $R_3$ and $R_4$ for the first document being denoted by $R_1'$, $R_2'$, $R_3'$ and $R_4'$ for the second document, respectively. In the example shown in FIG. 4, the radial position of the end of the trailing pilot signal for the first document coincides with the initial radial position at which a leading pilot signal is recorded for the second document. As a result, termination of the trailing pilot signal for the first document ($R_4$) coincides with commencement of the leading pilot signal for the second document ($R_1'$). Alternatively, a guard band could be provided between documents.

It is important to note that while the leading pilot signal for each document begins at sector 00 (positions $R_1$ and $R_1'$ respectively), the lengths of the recorded leading pilot signals (from $R_1$ to $R_2$ and $R_1'$ to $R_2'$) are not the same for the two documents. This is because the disk storage device 34 is spinning constantly and, because there is no phase synchronization between the document scanner and memory device, the disk 34 will normally be in a different angular orientation each time the scanning carriage 31 reaches position $S_1$. The result is that there is one disk revolution of uncertainty as to where document information starts being recorded on the disk storage device 34. In FIG. 4, the recorded leading pilot signal for the first document ($R_1$ to $R_2$) is relatively short, which indicates that the sector 00 sector mark had just passed the sector 00 detector 40 when the scanning carriage 31 reached position $S_1$. As a result, it takes almost an entire disk revolution before the sector 00 sector mark is detected by the sector detector 40, thereby leaving only a short time in which to record the pilot signal before the scanning carriage 31 reaches position $S_2$. The relatively long length of the recorded pilot signal for the second document ($R_1'$ to $R_2'$) indicates that for the second document the sector 00 sector mark was close to, but had not yet passed, the sector 00 detector 40 when the scanning carriage 31 reached position $S_1$. The sector 00 sector mark is thus detected relatively soon so that a relatively long time was available in which to record the pilot signal before the scanning carriage 31 reached position $S_2$.

Figure 5A:
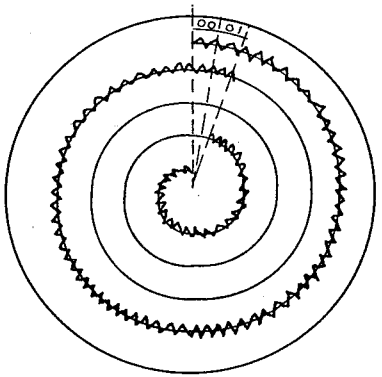
Figure 5B:
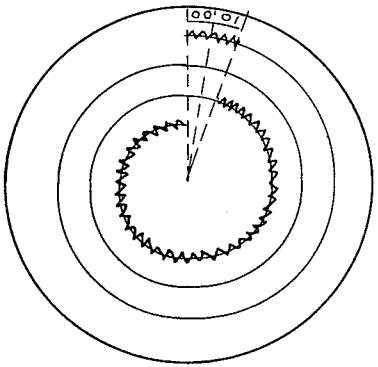
Figure 5C:
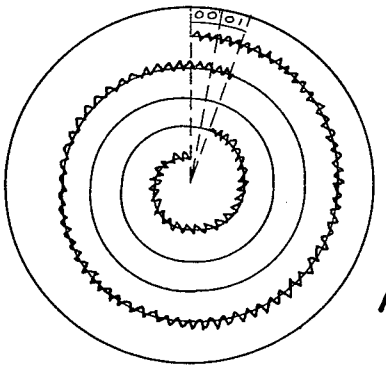
Figure 5D:
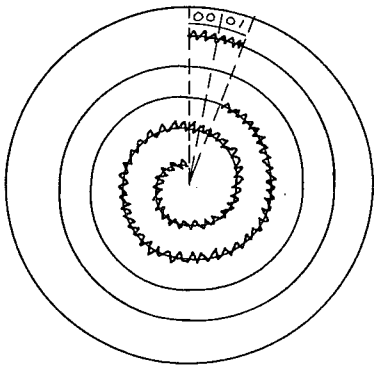

As discussed above, the composite information signal begins and ends at the same angular location on the disk 34 for all documents. Under certain circumstances, however, the composite information signal will not occupy the same number of sectors on the disk 34 unless precautions are taken in accordance with the present invention. To illustrate this problem, FIGS. 5*a* and 5*b* show, respectively, two composite information signals recorded on a disk storage device. It is assumed that the maximum duration of the leading pilot signal (L.P.S.) (which is determined by the time it takes for the scanning carriage 31 to travel from position $S_1$ to position $S_2$) is 38 sectors, and this condition is shown in FIG. 5*a*. The document information signal is assumed to occupy 72 sectors. If recording of the trailing pilot signal ceases at the next sector 00 after termination of the document information signal, the composite information signal will occupy four disk revolutions, as shown in FIG. 5*a*. FIG. 5*b* illustrates the case where the leading pilot signal occupies 2 sectors. Under the same conditions discussed in connection with FIG. 5*a*, the resulting composite information signal occupies only three, instead of four, disk revolutions. In the case where the memory device is of the erasable type, it is desirable for all composite information signals to have the same duration, thereby ensuring that recording of a composite information signal completely erases a previously recorded composite information signal recorded at the same storage location. To ensure that all composite signals have the same duration, the system controller 28 maintains a count of the number of SECTOR COUNT signals that have occurred since recording began of the leading pilot signal. Because the total number of sectors per composite information signal is predetermined, the system controller 28 extends recording of the trailing pilot signal until the composite information signal occupies the desired number of sectors. FIGS. 5*c* and 5*d* illustrate the identical composite information signals described in connection with FIGS. 5*a* and 5*b*, respectively, with the exception that the duration of the trailing pilot signal is determined by monitoring the SECTOR COUNT signal, as described above. As is seen, both of the composite information signals shown in FIGS. 5*c* and 5*d* occupy four disk revolutions of storage space.

While the composite information signal recorded for each document begins and ends at sector 00, and takes up the same number of disk revolutions for each similarly-sized document, the location of actual document information varies within the composite information signal for each document. This uncertainty in the position of recorded document information is the direct result of omitting a servo system between the rotating disk storage device 34 and the scanning carriage 31. This positional uncertainty, however, can be tolerated with no adverse effects upon document copies if playback of the disk 34 and printing of the document copy are done in accordance with the present invention.

MEMORY DEVICE AND PRINTER OPERATION DURING PLAYBACK

Figure 6:
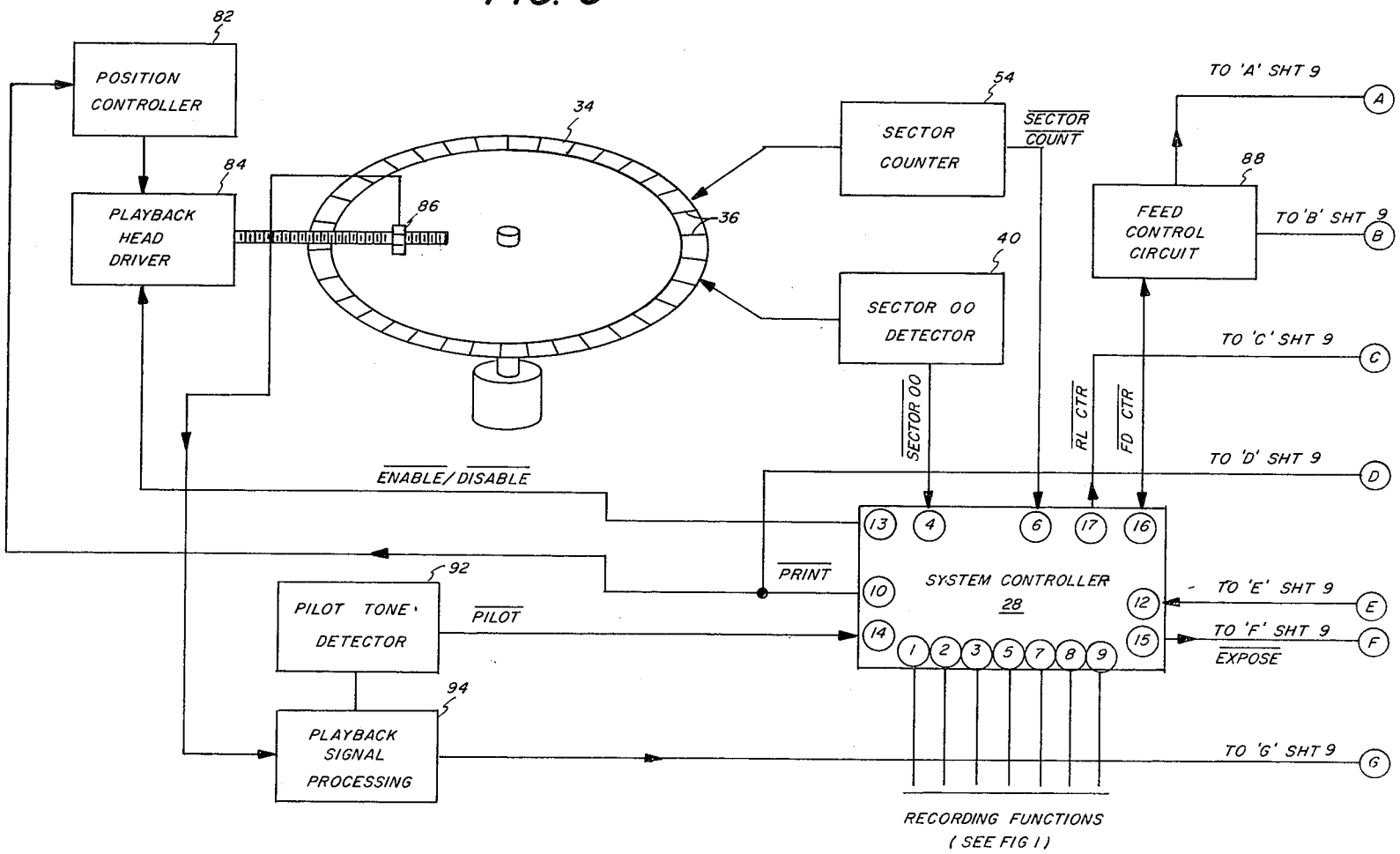
FIG. 6 and FIG. 6 (cont.) are a block diagram showing memory and printing sub-systems of an electronic copier in accordance with the present invention.
Figure 6:
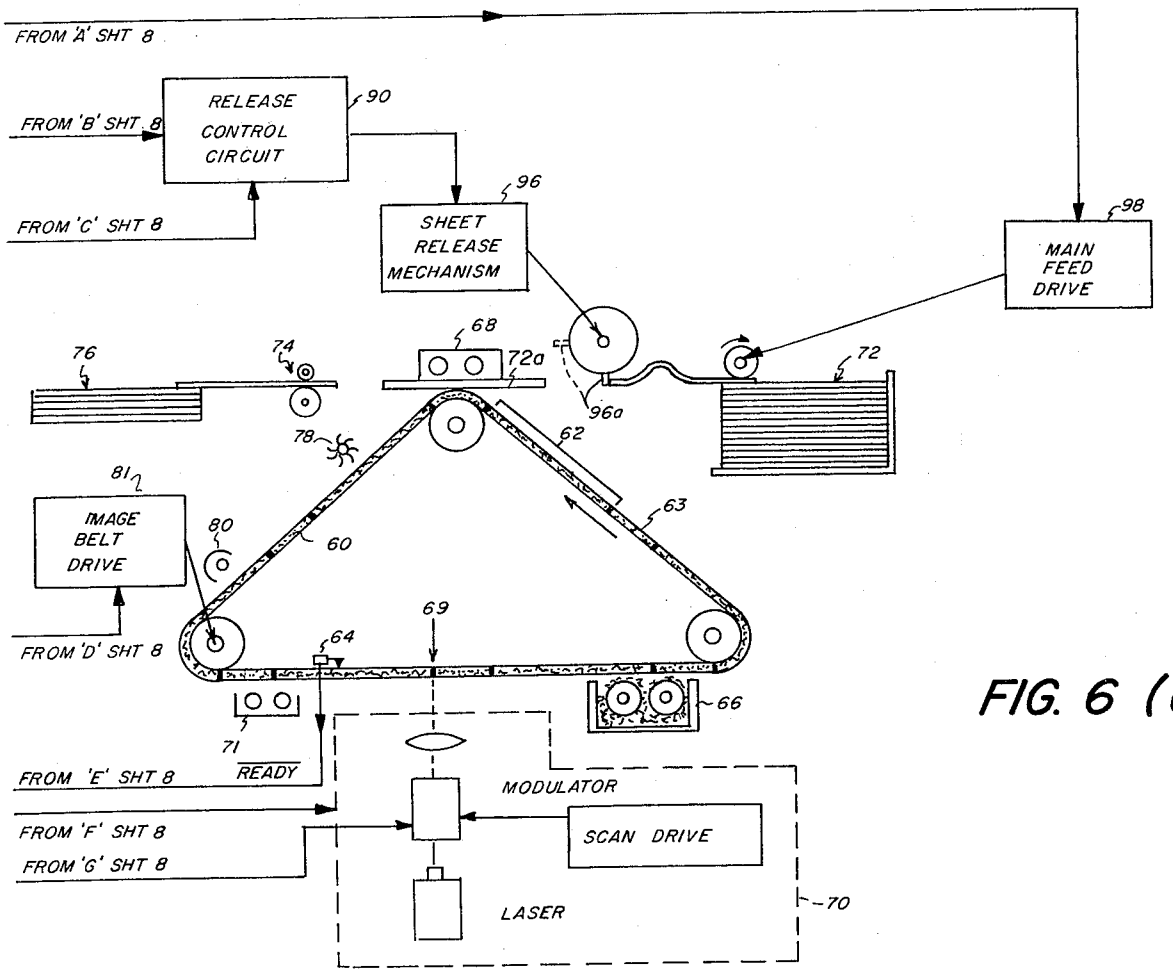

FIG. 6 is a generalized block diagram illustrating the playback operation of an electronic copier in accordance with the present invention. Copies of the original document are produced from an electrophotographic printer that includes a laser scanner. Before discussing the playback operation, it is convenient to discuss generally the operation of the printer. The printer includes a photoconductive image belt 60 upon which document information is exposed (after charging at a charging station 71) by a laser scanning system 70. Exposure (at an exposure station 69) of document information on the image belt 60 is made wholly within image areas, one of which is numbered 62, thereby avoiding the situation where document information is exposed over a seam 63 in the image belt 60. A belt position sensor 64 is used to determine when an image area 62 is in position for exposure. After exposure, the image area passes through a development station 66 where toner is applied to develop the image. The developed image is advanced to a transfer station 68 where the toned image is transferred to a copy sheet 72*a* fed from a sheet supply 72. The copy sheet bearing the toned image is then transported through a fixing station 74 (e.g., a fusing roller) and into an output bin 76. The image area from which the toned image was transferred is advanced through a cleaning station 78 (to clean the image area of remaining toner) and an erase station 80 (to remove residual charge). The above-described electrophotographic printing process is generally of a type as disclosed in U.S. Pat. Nos. 3,914,047 and 4,105,324 which are hereby incorporated by reference.

Figure 7:
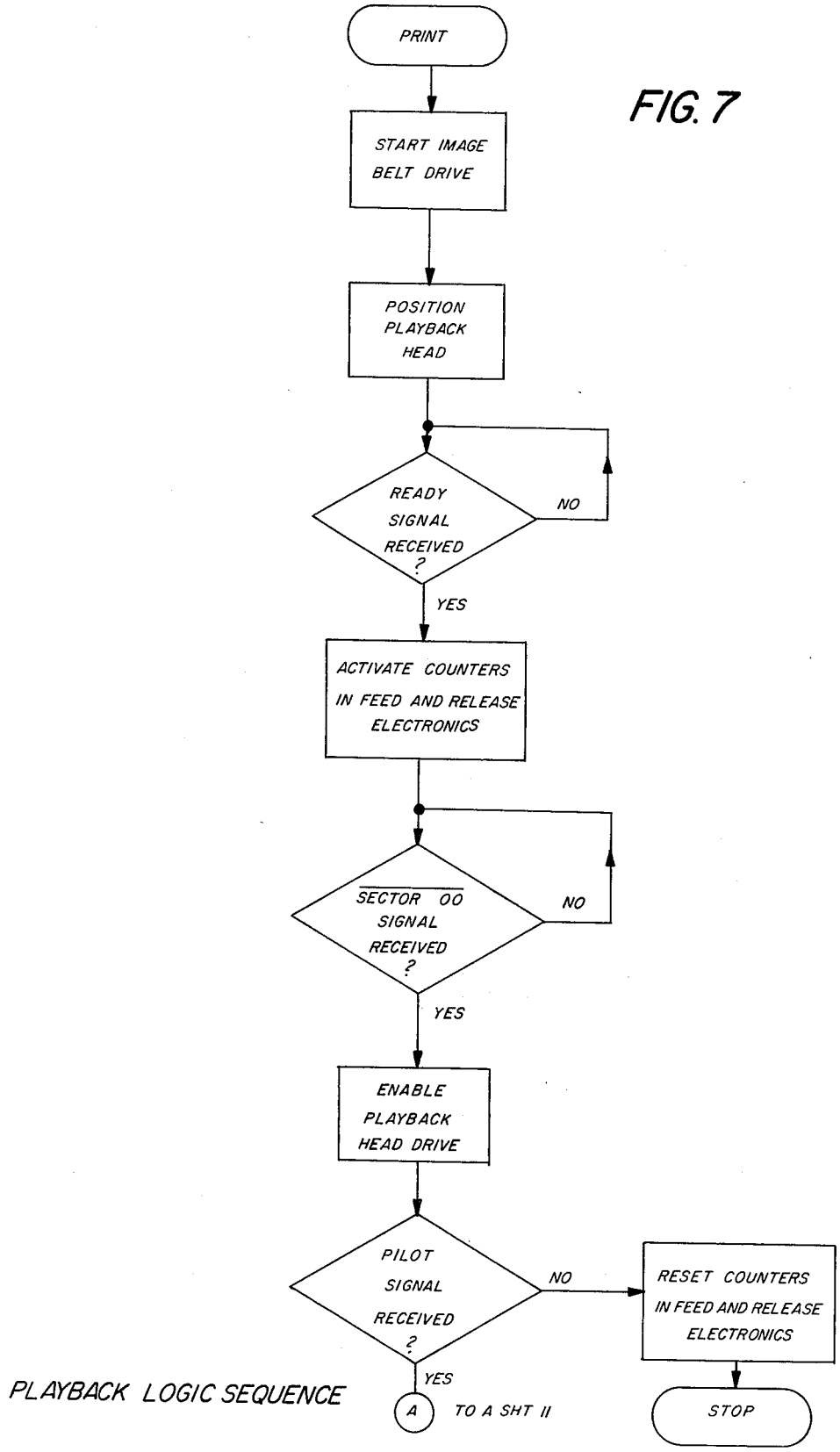
FIG. 7 and FIG. 7 (cont.) are a flow chart showing the logic sequence followed by a system controller during the playback mode of copier operation.
Figure 7:
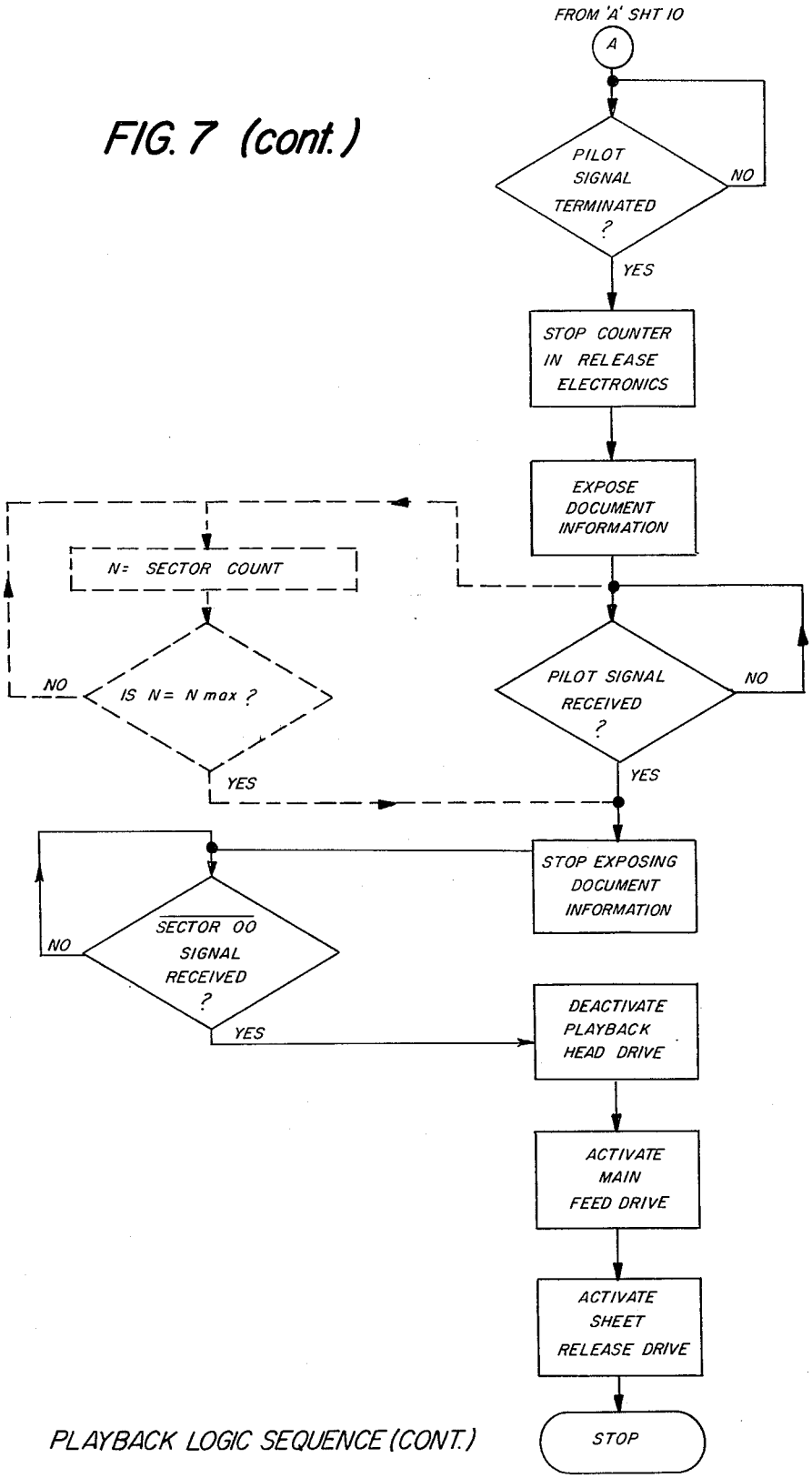

In connection with the following description of playback operation, reference is also made to FIG. 7 which shows the logic sequence followed by the system controller 28 during playback. Referring now to FIGS. 6 and 7, the playback operation begins upon the generation of a PRINT signal by the system controller 28. The PRINT signal enables an image belt drive mechanism 81 which starts the image belt 60 in motion. Also in response to the PRINT signal, a position controller 82 causes a playback head driver 84 to position a playback head 86 for playback of recorded information. The system controller 28 then waits for READY signal from the belt position sensor 64, indicating that an image area 62 is in position for exposure by the laser scanner 70. Upon receipt of the READY signal, the system controller 28 sends FD CTR (feed counter) and RL CTR (release counter) signals to the feed control circuit 88 and the release control circuit 90, respectively, which signals start certain counters in these devices, as will be discussed in detail with reference to FIG. 11. In response to the next SECTOR 00 signal received by the system controller 28 from the sector 00 detector 40, an ENABLE signal is generated that causes the playback head driver 84 to start the playback head 86 in motion. At this point, the system controller 28 should receive a PILOT signal from a pilot tone detector 92. Lack of a PILOT signal indicates a system malfunction which causes the system controller 28 to reset the counters in the feed control circuit 88 and the release control circuit 90, and then shut the system down. It will be assumed for purposes of the following discussion that the system is operating properly and that a PILOT signal is received by the system controller 28. In response to the termination of the PILOT signal (which indicates the onset of document information), the system controller 28 generates a second RL CTR signal which stops a counter in the release control circuit 90. Also in response to termination of the PILOT signal, the system controller 28 generates an EXPOSE signal that turns on the laser scanner 70. Document information played back from the disk storage device 34 is processed by a playback signal processing circuit 94 and applied to a laser beam modulator. The modulated laser beam repeatedly scans across the image belt 60 exposing document information within an image area 62.

The system controller 28 knows when playback of document information is complete by receiving a second PILOT signal from the pilot tone detector 92 marking the onset of the trailing pilot signal. (Alternatively, as indicated by broken lines in FIG. 7, the SECTOR COUNT signal produced by the sector counter 54 may be monitored to determine the end of document information.) In response, the system controller 28 generates a second EXPOSE signal which turns off the laser scanner 70, thereby terminating exposure of the image belt 60. Upon receipt of the SECTOR 00 signal from the sector 00 detector 40 that marks the end of the trailing pilot signal, the system controller generates a DISABLE signal that disables the playback head driver 84. (Alternatively, as discussed in connection with FIGS. 5*a* through 5*d*, the SECTOR COUNT signal produced by the sector counter 54 can be used to determine the end of the trailing pilot signal.)

It will be noted that the playback head driver 84 was enabled at a time when an image area 62 first entered the exposure station 69. But exposure of document information did not commence until the termination of the leading pilot signal. There is, therefore, a positional uncertainty in the location of document information within the image area 62 (and the image area 62 should be large enough to accommodate such uncertainty). The magnitude of such uncertainty is the distance traveled by the image belt 60 in the time it takes the disk storage device 34 to complete two revolutions. For example, if the disk storage device is divided into 36 sectors and one scan line of document information is recorded per sector, there will be a 72 scan line uncertainty in the location of document information within the image area 62. One disk revolution of uncertainty is due to the fact that the leading pilot signal varies in duration by up to one disk revolution. The second disk revolution of uncertainty arises from playback because the disk storage device 34 may make up to one complete revolution before a sector 00 marker is detected and playback of the composite information signal begins. This two disk revolution uncertainty in the location of document information within an image area 62 is directly attributable to the lack of phase synchronization between the various copier components. If left unattended, such positional uncertainty will ultimately appear as improper registration of document information on the hard copy replicate. In order to understand how such registration error is avoided by practice of the present invention, it is necessary to consider the printing process in more detail.

It remains for the exposed and toned image area 62 to advance (after development) to the transfer station 68 whereat transfer of toner to a copy sheet will occur. The function of the feed control circuit 88, the release control circuit 90, the sheet release drive 96 and the main feed drive 98 is to ensure that a copy sheet 70 will be fed to the transfer station 68 at such a time that the transferred image will assume a registration that corresponds to the registration of document information on the original document. Absent such provision, there would be substantial registration error, as discussed above.

The sheet feeding mechanism is divided into two parts: (1) a main feed drive 98 and (2) a sheet release mechanism 96. This type of sheet feeding mechanism is disclosed in U.S. Pat. No. 4,019,733, which is hereby incorporated by reference. The general operation of such a sheet feeding mechanism is as follows (the reader being referred to the above-referenced patent for further details): The main feed drive 98 feeds a copy sheet into contact with a tab 96*a* forming part of the sheet release mechanism 96. At some later time, the tab 96*a* is moved from the sheet path, thereby allowing the copy sheet to be fed to the transfer station 68.

In accordance with the present invention, registration errors are avoided by controlling the main feed drive 98 and the sheet release mechanism 96 by the feed control circuit 88 and the release control circuit 90, respectively. To understand such operation, first assume that the tab 96*a* of the sheet release mechanism 96 is in a position (indicated by broken lines) so that it will not prevent a copy sheet from passing directly from the sheet supply bin 72 to the transfer station 68. The feed control circuit 88 is designed to activate the main feed drive 98 at such a time that were document information exposed immediately upon arrival of an image area 62 at the exposure station 69, the transferred document information would be in proper registration on the copy sheet. This can always be done because the time required for an exposed image area to advance to the transfer station 68 and the time required for a copy sheet to be directly fed from the supply bin 72 to the transfer station 68 are known, assuming the belt 60 advances at a uniform speed. The feed control circuit 88 is thus set to wait a predetermined time after an image area enters the exposure station 69 (marked by the READY signal) and then activate the main feed drive 98. The predetermined time delay is chosen to produce the registration condition just described.

In applications wherein the belt 60 does not always advance at a uniform velocity (due, for example, to belt slippage) the main feed drive 98 can be activated in response to the actual position of the image area 62 as determined from signals produced by the belt position sensor 64.

As previously explained, document information will not, in general, be exposed at the start of an image area. In the example described above, document information will begin up to 72 scan lines after the start of the image area 62. Further, the position of document information within an image area will vary from document to document. To compensate for such variations, the present invention provides a release control circuit 90 which, in effect, "knows" how much additional time each copy sheet should be delayed before being passed to the transfer station 68 in order to result in proper registration. The release control circuit 90 makes this determination based upon the time at which an image area enters the exposure station 69 (occurrence of the READY signal) and the time at which the laser scanner 70 begins exposing document information (termination of the leading pilot signal or, alternatively, occurrence of the EXPOSE signal). The time difference between these two events is a direct measure of the additional delay required to be introduced in the sheet feed path to result in registration of document information on the copy sheet that corresponds with the registration of document information on the original document. The release control circuit 90 thus holds the tab 96*a* in a position that obstructs the sheet feed path for this time period. A detailed description of the operation of the feed control circuit 88 and the release control circuit 90 is given below with reference to FIG. 11.

Figure 8:
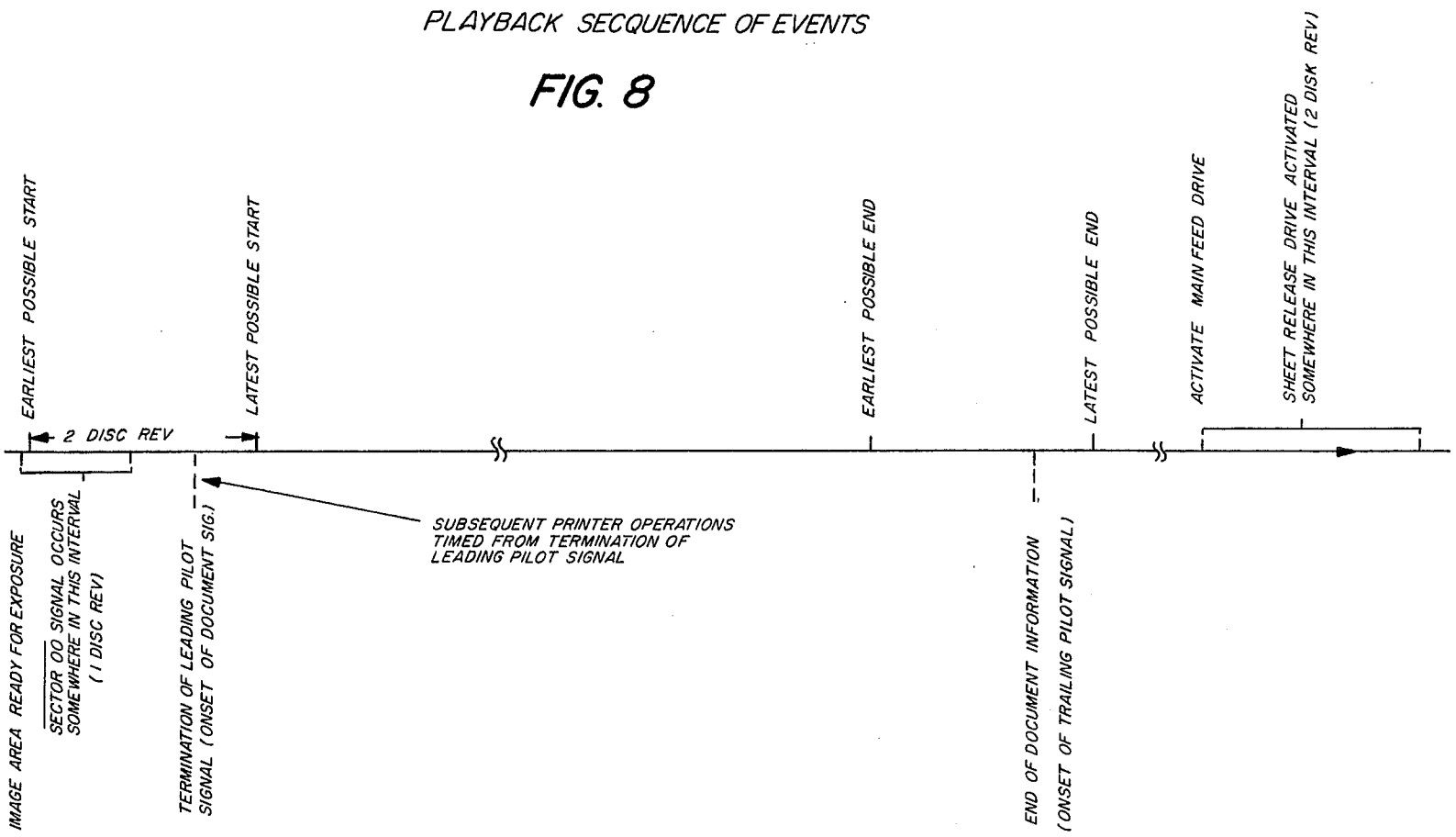
FIG. 8 is a timing diagram showing the order of certain events occurring during the playback mode of copier operation.

The temporal occurrence of certain events that occur in the playback process is shown in FIG. 8. At some point within one revolution of the disk storage device 34 after an image area enters the exposure station, a SECTOR 00 signal will be produced. Within an additional disk revolution, the leading pilot signal will terminate and playback of document information will begin. The "Earliest Possible Start" and "Latest Possible Start" of playback of document information are indicated. At a fixed time interval after an image area enters the exposure station, the main feed drive is activated. Somewhere within a time period corresponding to two disk revolutions (and it varies from document to document), the sheet release mechanism is activated.

SUMMARY

To briefly summarize the overall operation of the disclosed electronic copier, document information is recorded on a memory device, such as a rotatable disk storage device, in the form of a composite information signal comprised of a document information signal sandwiched between leading and trailing pilot signals. The leading pilot signal begins, and the trailing pilot signal ends, at predetermined angular locations on the disk storage device. The presence of a self-distinguishing sector marker (located, in the above example, between sector 00 and sector 35) on the outer periphery of the disk storage device permits identification of such predetermined angular positions. Since the leading pilot signal varies in duration from document to document by as much as one disk revolution, there is a corresponding uncertainty in the angular location of the recorded document information. Such locational uncertainty occurs because there is no phase synchronization between the document scanner and the memory device.

In the above described embodiment, a laser scanner is used to expose document information within discrete image areas on a photoconductive image belt. Playback of the composite information signal begins sometime within one disk revolution of an image area entering the exposure station. Sometime within one disk revolution of the beginning of the playback of the composite information signal, the document information signal begins being played back. The laser scanner then exposes document information within the image area. As a result, there are a total of two disk revolutions of uncertainty (72 scan lines in the above-described embodiment) in the location of document information within the image area. Absent the present invention, such uncertainty would result in improperly registered document information on the copy. To prevent such registration error, the termination of the leading pilot signal is used as a timing reference for a sheet feed mechanism in such a manner as to ensure proper registration of document information on the copy.

DETAILED DESCRIPTION OF CERTAIN CIRCUITS DESCRIBED GENERALLY ABOVE

Figure 9:
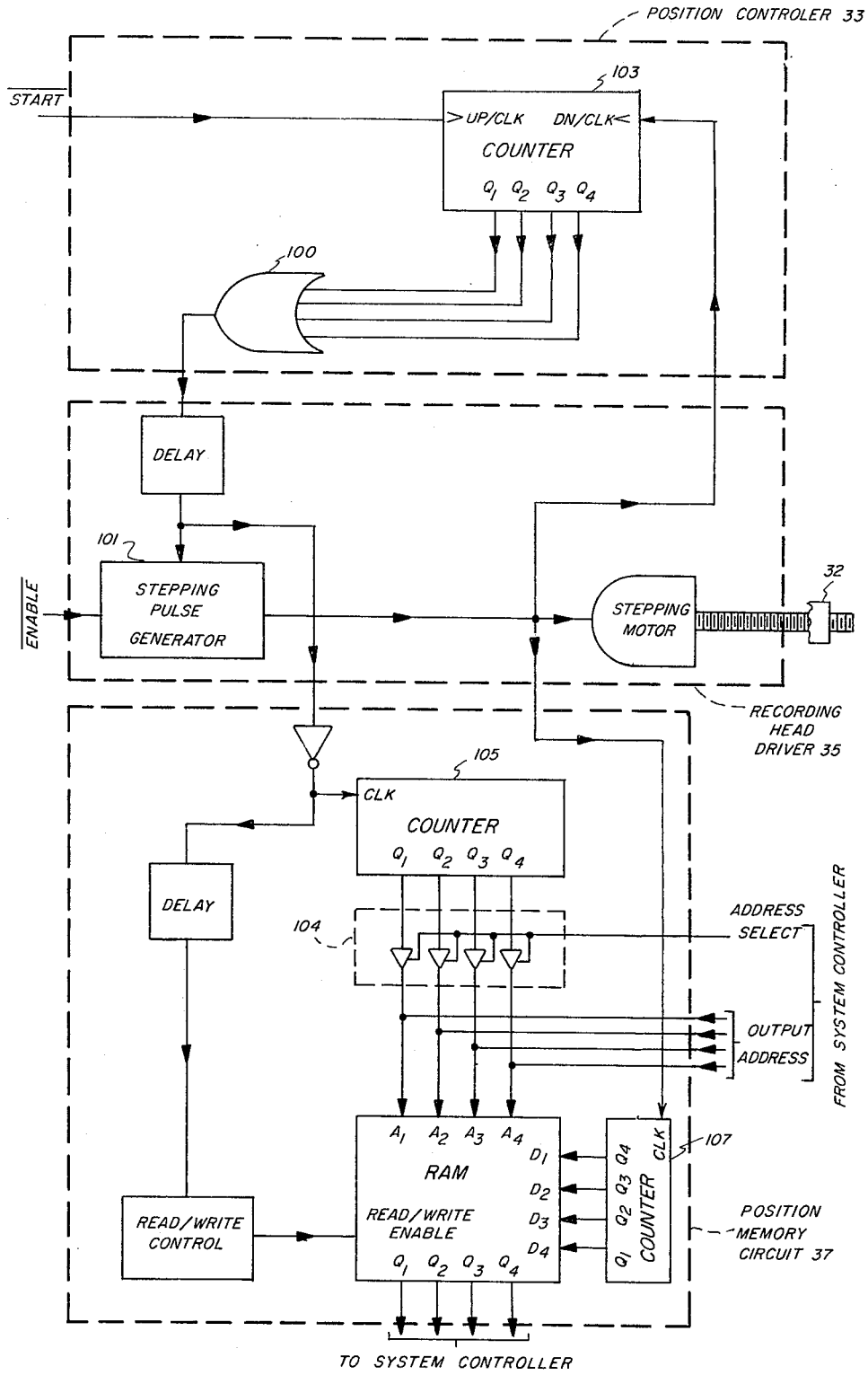
FIGS. 9, 10*a*, 10*b*, 10*c*, 10*d*, 10*e*, 10*f*, and 11 are electrical schematic drawings and timing diagrams associated therewith useful in describing in detail certain copier operations and associated circuitry.

FIG. 9 shows a detailed circuit diagram for the position controller 33, the recording head driver 35, and the position memory circuit 37, all of which were described in connection with FIG. 1. FIGS. 10*a* through 10*g* are timing diagrams useful in describing the operation of the circuit shown in FIG. 9. It is assumed that three composite document information signals are to be recorded corresponding to first, second and third documents, respectively. A stepping motor is used to position the recording head 32 at respective initial radial positions at which recording will begin of the composite information signals corresponding to the three documents. Each "step" of the stepping motor increments the recording head 32 one storage location on the disk storage device. Three "steps", for example, of the stepping motor would therefore place the recording head 32 in a position to begin recording at the third storage location (assuming the recording head 32 began at an initial position corresponding to storage location zero). It is further assumed that it is desired to start recording of document one at storage location one, document two at storage location three, and document three at storage location six.

Figures 10A, 10B, 10C, 10D, 10E, 10F:
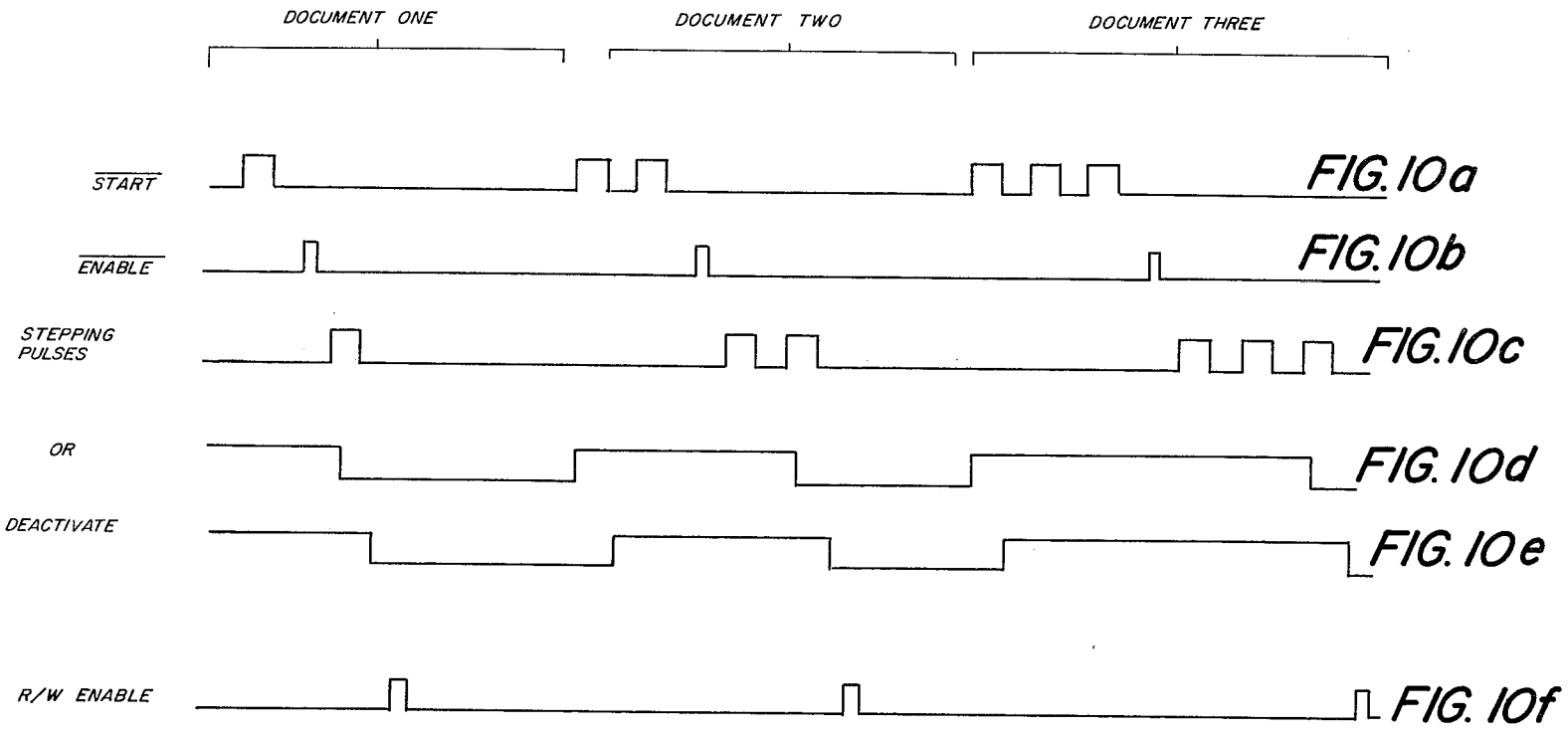

Referring now to FIGS. 9 and 10*a* through 10*g*, the START signal generated by the system controller for document one is a single positive going pulse (FIG. 10*a*). This pulse causes counter 103 to count to one on the positive edge transition. Upon receipt of the ENABLE signal (FIG. 10*b*), a stepping pulse generator 101 starts producing stepping pulses (FIG. 10*c*), each of which causes the stepping motor to increment one step. The positive edge of each stepping pulse causes counter 103 to count down one count. But because counter 103 initially counted to one in response to the START signal, the first stepping pulse causes counter 103 to count down to zero, thereby causing the output of an OR gate 100 connected to the counter 103 outputs $Q_1$ through $Q_4$ to go low (FIG. 10*d*). After a delay sufficient to allow one complete stepping pulse to be produced, the low going output of the OR gate 100 deactivates the stepping pulse generator 101 (FIG. 10*e*). For document one, therefore, a single pulse was produced by the stepping pulse generator, thereby stepping the recording head 32 to storage location one.

For document two, the START signal generated by the system controller is comprised of a pair of positive pulses (FIG. 10*a*) that cause counter 103 to count up to two. The output of the OR gate 100 thus returns to a high state (FIG. 10*d*), thereby removing the deactivate signal from the stepping pulse generator 101. In response to the ENABLE signal for document two, the stepping pulse generator 101 produces two stepping pulses before being deactivated by a low state signal from the OR gate 100. The recording head 32 has thus been advanced an additional two storage locations, to storage location three.

In a similar manner, the START signal for document three is a series of three positive pulses that cause the recording head 32 to be advanced an additional three storage locations to storage location six. The final result, therefore, is that the composite information signals corresponding to documents one, two and three begin at storage locations one, three and six, respectively, as desired.

Also as shown in FIG. 9, the position store 37 includes a random access memory (RAM), see FIG. 9. The input address is generated by counter 105 which increments one count each time the output of the OR gate 100 goes low. Since this occurs once and only once for each document, the input address applied to address lines $A_1$ through $A_4$ coincides with the document count. The input data for each input address is produced by counter 107. Each stepping pulse increments counter 107 by one count, so the information applied to input data lines $D_1$ through $D_4$ represents the total number of stepping pulses produced by the stepping pulses generator. This count coincides, therefore, with the storage location of the corresponding document. FIG. 10*f* shows the read/write enable signal applied to the RAM. When the read/write enable signal goes high, the input on input data lines $D_1$ through $D_4$ is stored at the address location appearing on address lines $A_1$ through $A_4$. It is apparent from the timing diagrams shown in FIGS. 10*c*, 10*e* and 10*f* that the first read/write enable pulse occurs at a time when a one count is stored in both counters 105 and 107. The second read/write enable pulse occurs at a time when a count of two is stored in counter 105 and a count of three is stored in counter 107. The third read/write enable pulse occurs when a count of three is stored in counter 105 and a count of six is stored in counter 107. It is therefore apparent that the address location within the RAM is the document count and the information stored at that address location is the storage location at which recording of the corresponding composite information signal began.

This information is available to the system controller 28 by bringing an address select line to a low state, thereby bringing a group tri-state buffers 104 to a high impedance state which effectively isolates the counter 105 from the RAM address lines $A_1$ through $A_4$. The system controller 28 can then address the RAM and receive, via output information lines $Q_1$ through $Q_4$, the information located at the address location. (It will be apparent that the system controller 28 would not normally request this output information when information was being written into the RAM.)

To play back a particular document (referring now also to devices described in connection with FIG. 6), the system controller 28 addresses the RAM with the corresponding document count and receives the storage location as output data. The position controller 82 can then be told by the system controller 28 at what storage location to position the playback head 86. (The playback head driver 84 and the position controller 82 can be similar to the recording head driver 35 and the position controller 33, respectively, described in detail above.)

Figure 11:
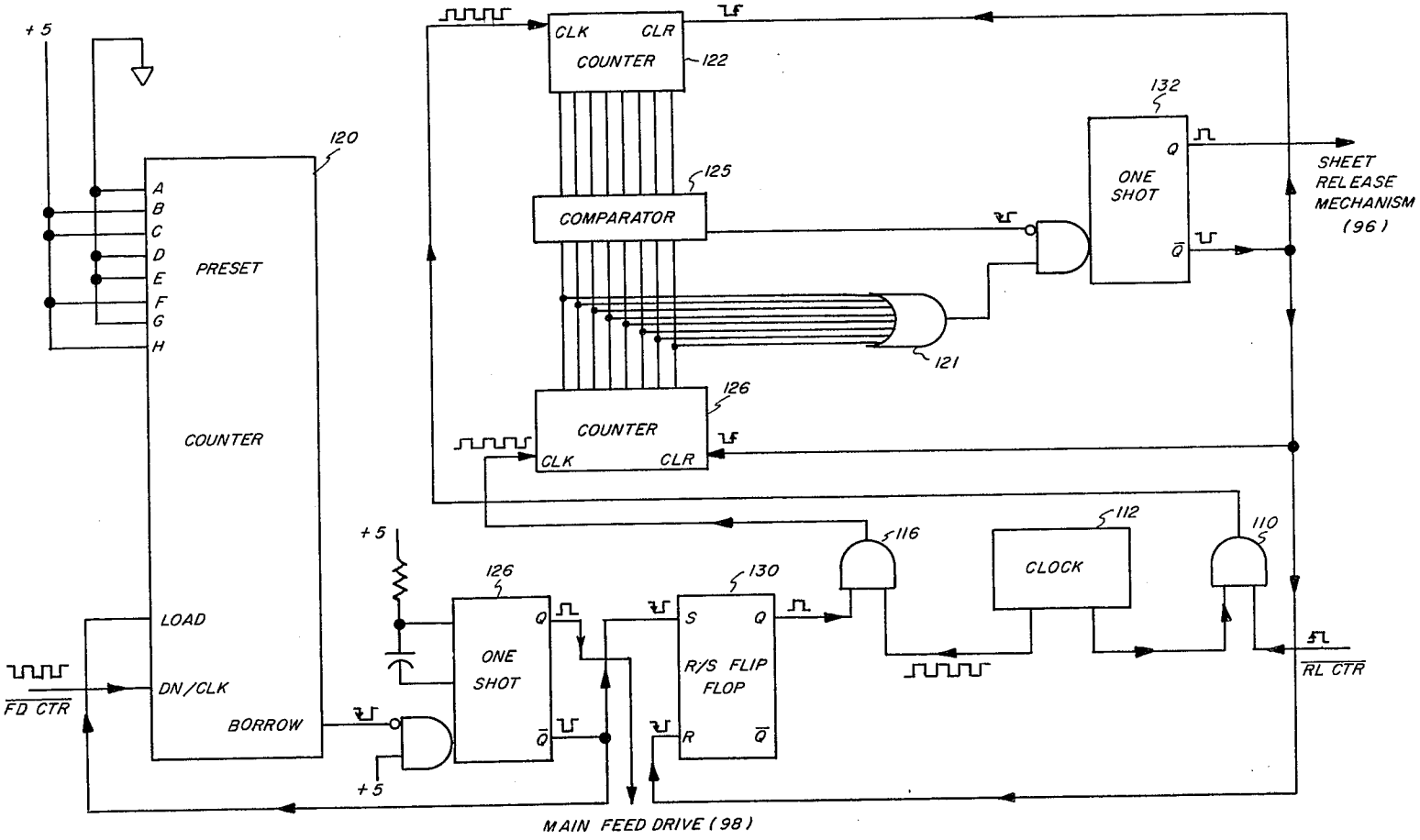

FIG. 11 is a detailed electrical schematic of the feed control circuit 88 and the release control circuit 90 shown in FIG. 6. It will be recalled that these devices control the operation of the main feed drive 98 and sheet release mechanism 96 in such a manner as to ensure proper registration of document information on the copy. In response to the READY signal from the belt position sensor 64 (indicating an image area has arrived at the exposure station), the system controller 28 generates a FD CTR signal that causes counter 120 to count down from a preset count. The preset count is so chosen that the time taken for counter 120 to count to zero coincides with the time at which the main feed drive 98 should be activated after an image area enters the exposure station 69 in order to result in the image registration condition described above. While this is happening, the RL CTR signal produced by the system controller 28 (also in response to the READY signal) enables an AND gate 110, thereby causing counter 122 to count clock pulses produced by a clock 112. The system controller 28 disables the AND gate 110 (via the second RL CTR signal), and thus stops counter 122, when it detects the termination of the leading pilot signal (which corresponds to the onset of document information). The count stored in counter 122, therefore, corresponds to the time period between an image area entering the exposure station 69 and the beginning of exposure of document information, thereby providing a measure of the position of document information within the image area.

In the meantime, when counter 120 counts past zero, the borrow goes low and triggers a one shot 126. The "Q" output pulse from the one shot 126 is used to activate the main feed drive 98. The "$\overline{Q}$" output pulse from the one shot 126 loads counter 120 to the preset value and sets a flip-flop 130. The "Q" output pulse from flip flop 130 enables an AND gate 116, thereby causing counter 124 to count clock pulses produced by the clock 112. At some point, the counter 124 will reach the count stored in counter 122. At this time, a comparator 125 will trigger a one shot 132. The "$\overline{Q}$" output pulse from the one shot 132 then activates the sheet release mechanism 96. (The OR gate 120 is used merely to ensure that the comparator will not trigger the one shot 132 when both counters 122 and 124 have zero count.) The "Q" output pulse from the one shot 132 resets the flip-flop 130 and clears counters 122 and 124, bringing the circuit back to its initial state.

The invention has been described in detail with particular reference to preferred embodiments thereof, but it will be understood that variations and modifications can be effected within the spirit and scope of the invention.

What is claimed is:

1. Electronic copier apparatus comprising:

(a) document information converting means for converting image information on a document into a document information signal;

(b) a memory device;

(c) recording means for recording information in said memory device, said recorded information being in the form of a pilot signal followed by said document information signal;

(d) playback means for playing back information recorded in said memory device;

(e) printer means, cooperative with said playback means, for producing a visible representation of said document information signal on a copy, said printer means including means for adjusting the registration of document information on a copy produced thereby in response to a registration control signal; and (f) control means for producing a registration control signal in response to the termination of said played back pilot signal and for applying said registration control signal to said printer means, thereby producing controlled registration of document information on said copy;

said memory device being comprised of a rotatable disk storage device;

said document information converting means being of a type that provides a line sequential document information signal for recording on said disk storage device;

said disk storage device being provided with a plurality of detectable sector marks that define a plurality of sectors on said disk storage device; and said recording means including means for recording a line of document information per sector of said disk storage device.

2. Apparatus as claimed in claim 1 wherein said recording means records information on said dynamic memory device in the form of a composite information signal comprised of said document information signal sandwiched by leading and trailing pilot signals, said composite information signal beginning and ending at substantially the same angular location on said disk storage device.

3. Electronic copier apparatus comprising:

(a) means for producing a composite information signal in the form of a pilot signal followed by a document information signal;

(b) a memory device;

(c) means for recording said composite information signal on said memory device;

(d) playback means for playing back said composite information signal from said memory device;

(e) means for detecting the termination of the played back pilot signal; and (f) printer means, cooperative with said playback means, for producing a visible representation of said document information signal on a copy, said printer means being of a type in which the registration of said visible representation of document information on the copy produced thereby is controlled by the detected termination of said played back pilot signal;

said composite information signal producing means comprising:

a document scanner for converting image information on a document into a line sequential document information signal;

a pilot signal generator; and switching means for selectively combining said pilot signal and said document information signal to produce said composite information signal.

4. Apparatus as claimed in claim 3 wherein:

said memory device is comprised of a rotatable disk storage device having a plurality of detectable sector marks thereon that define a plurality of sectors on said disk storage device; and said recording means includes means for recording a line of document information per sector of said disk storage device.

5. Apparatus as claimed in claim 3 wherein said composite information signal producing means includes means for producing a composite information signal in the form of a document information signal sandwiched by leading and trailing pilot signals.

6. Apparatus as claimed in claim 5 wherein:

said memory device is comprised of a rotatable disk storage device; and said recording means includes means for beginning and ending recording of said composite information signal at substantially the same angular location on said disk storage device.

7. Apparatus as claimed in claim 5 wherein said composite information producing means comprises:

a document scanner for converting image information on a document into a line sequential document information signal;

pilot signal generating means for producing leading and trailing pilot signals; and switching means for selectively combining said leading and trailing pilot signals with said document information signal to produce said composite information signal.

8. Apparatus as claimed in claim 7 wherein:

said memory device is comprised of a rotatable disk storage device having a plurality of detectable sector marks thereon that define a plurality of sectors on said disk storage device; and said recording means includes means for recording a line of document information per sector of said disk storage device.

9. Apparatus for use with a memory device and a printer of a type that produces a visible representation of a document information signal on a copy, said apparatus comprising:

(a) means for producing a plurality of composite information signals corresponding to respective documents wherein each of said composite information signals is comprised of a pilot signal followed by a document information signal, and wherein the respective durations of said pilot signals are not equal for all composite information signals;

(b) means for recording said composite information signals on said memory device;

(c) playback means for playing back from said memory device a selected one of said composite information signals; and (d) means, cooperative with said playback means, for adjusting the registration of document information on said copy by controlling printer operation in response to the termination of the pilot signal of the played composite information signal.

10. Apparatus as claimed in claim 9 wherein said recording means includes means for recording said composite information signals so that all such composite information signals have the same duration.

11. Apparatus as claimed in claim 12 for use with a memory device in the form of a rotatable disk storage device, wherein said recording means includes means for beginning recording of each of said composite information signals at substantially the same angular location on said disk storage device.

12. Apparatus as claimed in claim 9 wherein:

said composite information signal producing means includes means for producing a plurality of composite information signals corresponding to respective documents wherein each of said composite information signals is comprised of a document information signal sandwiched by leading and trailing pilot signals; and said recording means includes means for beginning recording of said composite information signals at substantially the same first angular location on said disk storage device, and for ending recording of said composite information signals at substantially the same second angular location on said disk storage device.

13. Apparatus as claimed in claim 12 wherein said recording means includes means for recording said composite information signals so that all such composite information signals have the same duration.

14. Apparatus as claimed in claim 13 wherein said recording means including means for beginning and ending recording of said composite information signals at substantially the same angular location on said disk storage device.

15. Apparatus as claimed in claim 9 wherein said printer is comprised of (1) an advancable image receiver, (2) means for advancing said image receiver, (3) an exposure station including an exposing source for exposing document information on said image receiver, (4) means for applying toner to said exposed image receiver, and (5) a transfer station including a sheet feed mechanism for feeding a sheet to contact an exposed and toned area of said image receiver thereby producing a toned copy sheet, and wherein said registration adjusting means includes:

means for determining the duration of the played back pilot signal;

means for detecting the termination of the played back pilot signal;

means for activating said exposing source to expose document information on said image receiver in response to the termination of the played back pilot signal; and means for activating said sheet feed mechanism a selected time interval after termination of the played back pilot signal, said selected time interval being equal to the time required to advance a location on said image belt from said exposure station to said transfer station plus the duration of the played back pilot signal, thereby providing a registration of document information on the copy sheet that corresponds to the registration of the document information on the original document.

16. Apparatus for use in synchronizing the operation of a printer device, the printer device being of a type that includes (1) an advancable image receiver, (2) means for advancing said image receiver, (3) an exposure station including an exposing source for exposing document information on said image receiver, (4) means for applying toner to said exposed image receiver, and (5) a transfer station including a sheet feed mechanism for feeding a sheet to contact an exposed and toned area of said image receiver thereby producing a toned copy sheet, said apparatus comprising:

(a) means for recording information on a memory device, said recorded information being in the form of a pilot signal followed by a document information signal;

(b) means for sensing the position of the image receiver to determine when an image area is in position for exposure by said exposing source;

(c) means, cooperative with said position sensing means, for playing back the information recorded on said memory device when the image area is in position for exposure;

(d) means for determining the duration of the played back pilot signal; and (e) means for activating the sheet feed mechanism a selected time interval after termination of the played back pilot signal that is proportional to the duration of the played back pilot signal.

17. A method of synchronizing the operation of a printer device, said printer device including an image receiver, a sheet feed mechanism, and exposing means for exposing document information on the image receiver for transference to a copy sheet fed from the sheet feed mechanism, the registration of document information transferred to said copy sheet being determined by the time at which said sheet feed mechanism is activated, said method comprising the steps of:

(a) recording information on a memory device having sector marks which define a plurality of sectors thereon, said information being recorded in the form of a pilot signal followed by a line sequential document information signal, one line of document information being recorded per sector;

(b) playing back the information recorded on the memory device;

(c) detecting the sector marks on the memory device;

(d) detecting the termination of the played back pilot signal;

(e) beginning operation of the exposing means in response to the termination of the played back pilot signal, the exposing means exposing one scan line of document information on the image receiver in response to the detection of a sector mark on the memory device; and (f) activating the sheet feed mechanism a selected time interval after termination of the played back pilot signal to feed a copy sheet into position for transference thereto of the exposed document information on the image receiver, said time interval being so selected that the transferred document information is in a desired registration on the copy sheet.

18. A method of synchronizing the operation of a printer device, said printer device including a sheet feed mechanism, exposing means, and an image receiver, the image receiver having an image area thereon and being arranged to advance the image area past an exposure station whereat the exposing means exposes document information on the image area, the exposed image area then advancing to a transfer station for transference of the exposed document information thereon to a copy sheet fed from the sheet feed mechanism, said method for use with a memory device having information recorded thereon in the form of a pilot signal followed by a document information signal, said method comprising the steps of:

(a) sensing the position of the image receiver to determine when an image area is in position for exposure by the printer device;

(b) playing back the information stored on the memory device when the image area is in position for exposure;

(c) detecting the termination of the played back pilot signal;

(d) initiating operation of the exposing means in response to termination of the played back pilot signal to expose document information on the image area of the image receiver; and (e) activating the sheet feed mechanism a determined time interval after termination of the played back pilot signal to feed a copy sheet to the transfer station for transference of the exposed document information on the image area to the copy sheet, the determined time interval being equal to the time required to advance said image area from said exposure station to said transfer station plus the duration of the played back pilot signal.

* * * * *

UNITED STATES PATENT AND TRADEMARK OFFICE

CERTIFICATE OF CORRECTION

PATENT NO. 4,332,463
DATED June 1, 1982
INVENTOR(S) Ronald R. Firth and Lee N. Davy It is certified that error appears in the above-identified patent and that said Letters Patent are hereby corrected as shown below:

Column 16, line 46, "Claim 12" should read -- Claim 10 --.

Signed and Sealed this

*Tenth* Day of *August 1982*

[SEAL]

*Attest:*

GERALD J. MOSSINGHOFF

*Attesting Officer*

*Commissioner of Patents and Trademarks*